US006893363B1

(12) United States Patent
Chen et al.

(10) Patent No.: US 6,893,363 B1
(45) Date of Patent: May 17, 2005

(54) APPARATUS FOR PRACTICING BASEBALL BATTING

(76) Inventors: Shyan-Wei Chen, No. 17, Kung 6 Road, Linkou 2nd Industrial Park, Taipei Hsien (TW); Stan M. Jurga, O.O. Box 1356, 1 Main St., Shirley, MA (US) 01464

( * ) Notice: Subject to any disclaimer, the term of this patent is extended or adjusted under 35 U.S.C. 154(b) by 7 days.

(21) Appl. No.: 10/753,422

(22) Filed: Jan. 9, 2004

(51) Int. Cl.[7] ..... A63B 71/00
(52) U.S. Cl. ..... 473/417; 473/422
(58) Field of Search ..... 473/417, 415, 473/418, 422, 423, 429, 454; D21/715–719; 248/516

(56) References Cited

U.S. PATENT DOCUMENTS 2,884,250 A * 4/1959 Patterson ..... 473/423
3,139,282 A * 6/1964 Lande ..... 473/417
3,489,411 A * 1/1970 Morelli et al. ..... 473/417
3,883,138 A * 5/1975 Chorey ..... 473/417
4,227,691 A * 10/1980 Lefebvre et al. ..... 473/417
5,100,134 A * 3/1992 Becker ..... 473/417
5,386,987 A * 2/1995 Rodino, Jr. ..... 473/417
5,580,047 A * 12/1996 Shih et al. ..... 473/417
5,967,910 A * 10/1999 Lin ..... 473/417
6,682,445 B1 * 1/2004 Tanner ..... 473/417

* cited by examiner

*Primary Examiner*—Gregory Vidovich
*Assistant Examiner*—M. Chambers
(74) *Attorney, Agent, or Firm*—Troxell Law Office, PLLC

(57) ABSTRACT

An apparatus for practicing baseball batting includes a base formed of a rubber block, an upright detachably fastened to the top center of the base with a screw, a rubber stem detachably fastened to the top end of the upright, a tubular ball holder disposed above the stem and adapted to hold a ball for batting, and a peripherally grooved flexible rubber tube detachably coupled between the ball holder and the rubber stem and adapted to absorb shocks during batting.

1 Claim, 4 Drawing Sheets

APPARATUS FOR PRACTICING BASEBALL BATTING

BACKGROUND AND SUMMARY OF THE INVENTION

The present invention relates to a sports training equipment and, more particularly, to an apparatus for practicing baseball batting.

FIG. 1 is an elevational view of an apparatus for practicing baseball batting according to the prior art. According to this design, the apparatus comprises a base 6, an upright 7 upwardly extended from the top center of the base 6, an elongated ball holder 8 upwardly extended from the upright 7 and adapted to hold a ball 80 for batting. The upright 7 and the elongated ball holder 8 are respectively molded from rubber. If the user missed the ball 80 and hit the elongated ball holder 8 or the upright 7 during batting, the apparatus may be formed to fall to the ground. In order to prevent this problem, the base 6 may be attached with a weight. However, attaching the base 6 with a weight reduces the mobility of the apparatus.

The present invention has been accomplished under the circumstances in view. It is one object of the present invention to provide an apparatus for practicing baseball batting, which absorb shocks to prevent falling to the ground when received a heavy batting force from the user. It is another object of the present invention to provide an apparatus for practicing baseball batting, which is inexpensive to manufacture, and convenient for carrying. To achieve these and other objects of the present invention, the apparatus for practicing baseball batting comprises a base formed of a rubber block, the base having a center through hole through top and bottom surfaces thereof; an upright vertically supported on the top surface of the base, the upright having a metal screw holder fixedly provided in a bottom end thereof and fastened to the center through hole of the base with a screw, and a top coupling hole axially disposed in a top end thereof; a rubber stem upwardly extended from the upright, the rubber stem having an annular groove extended around the periphery thereof near a top end, and a bottom end press fitted into the top coupling hole of the upright; a flexible plastic tube, the flexible hollow plastic tube having a plurality of annular grooves extended around the periphery thereof at different elevations, a top coupling hole axially disposed in a top end thereof, and a bottom coupling hole axially disposed in a bottom end thereof and fastened to the top end of the rubber stem; and a tubular rubber ball holder, the tubular rubber ball holder having an expanded top ball seat adapted to hold a ball for batting, and an engagement flange extended around the periphery near a bottom end thereof and press-fitted into the top coupling hole of the flexible tube.

DETAILED DESCRIPTION OF THE INVENTION

Figure 1:
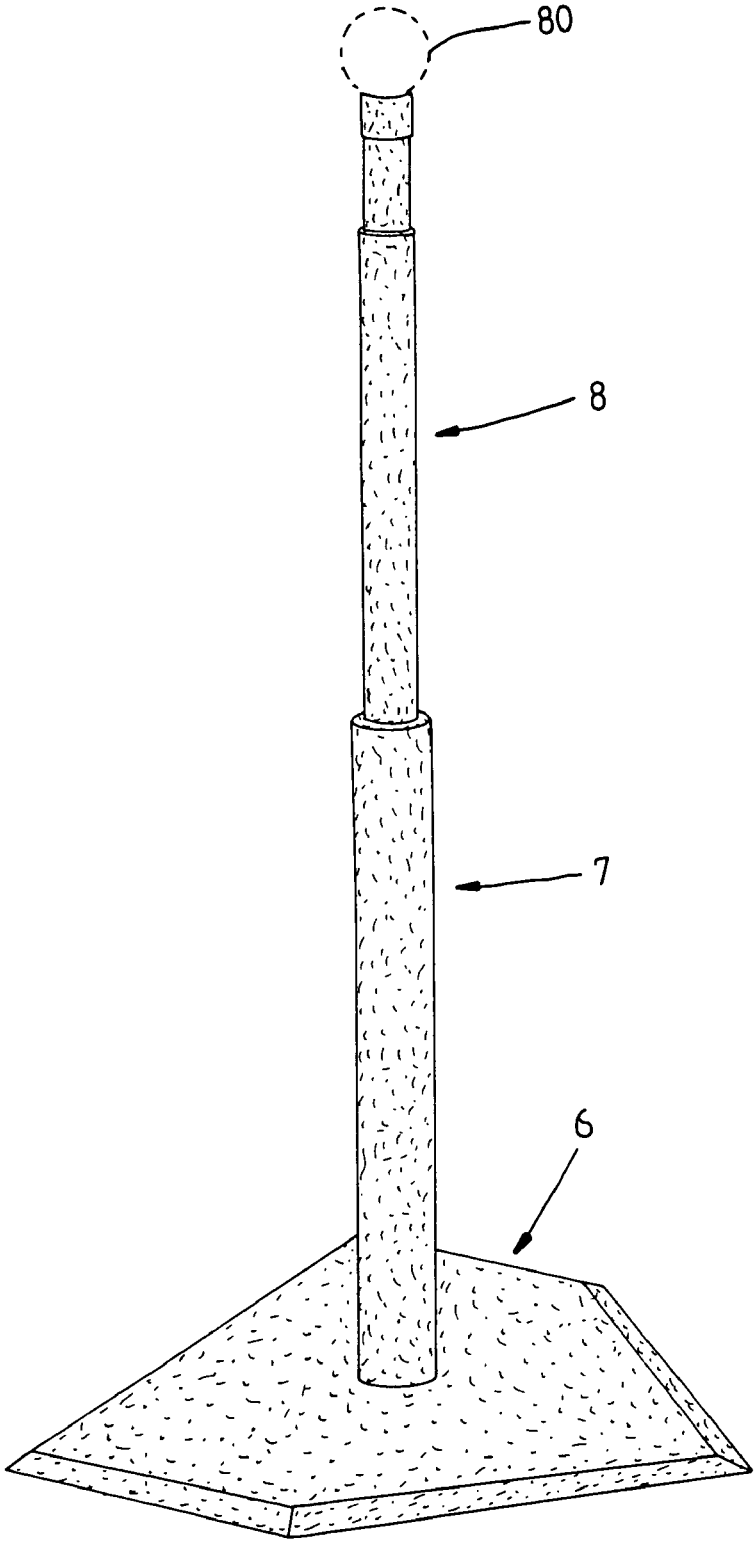
Fig. 1 PRIOR ART
FIG. 1 is an elevational view of an apparatus for practicing baseball batting according to the prior art.
Figure 2:
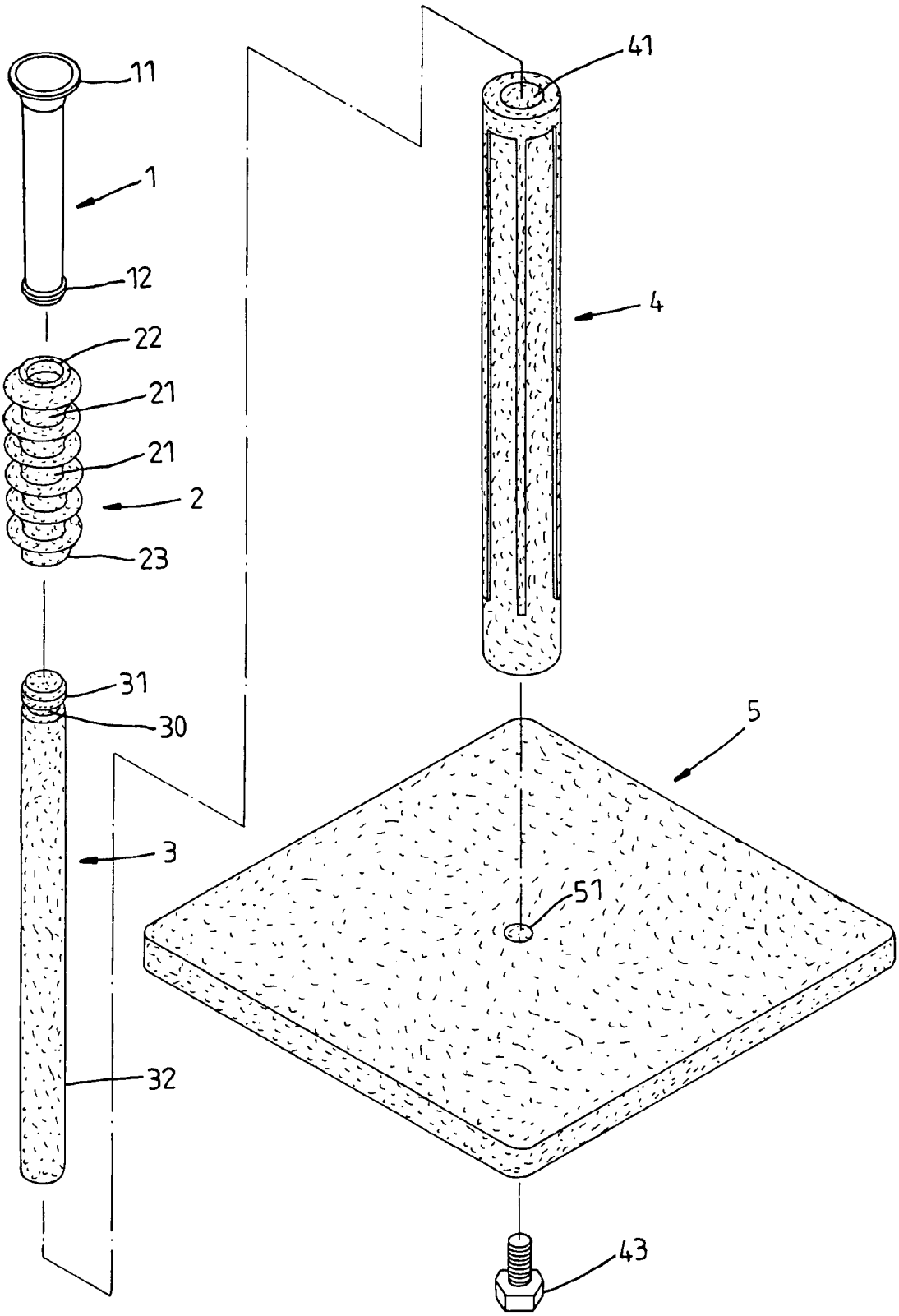
FIG. 2 is an exploded view of an apparatus for practicing baseball batting according to then present invention.
Figure 3:
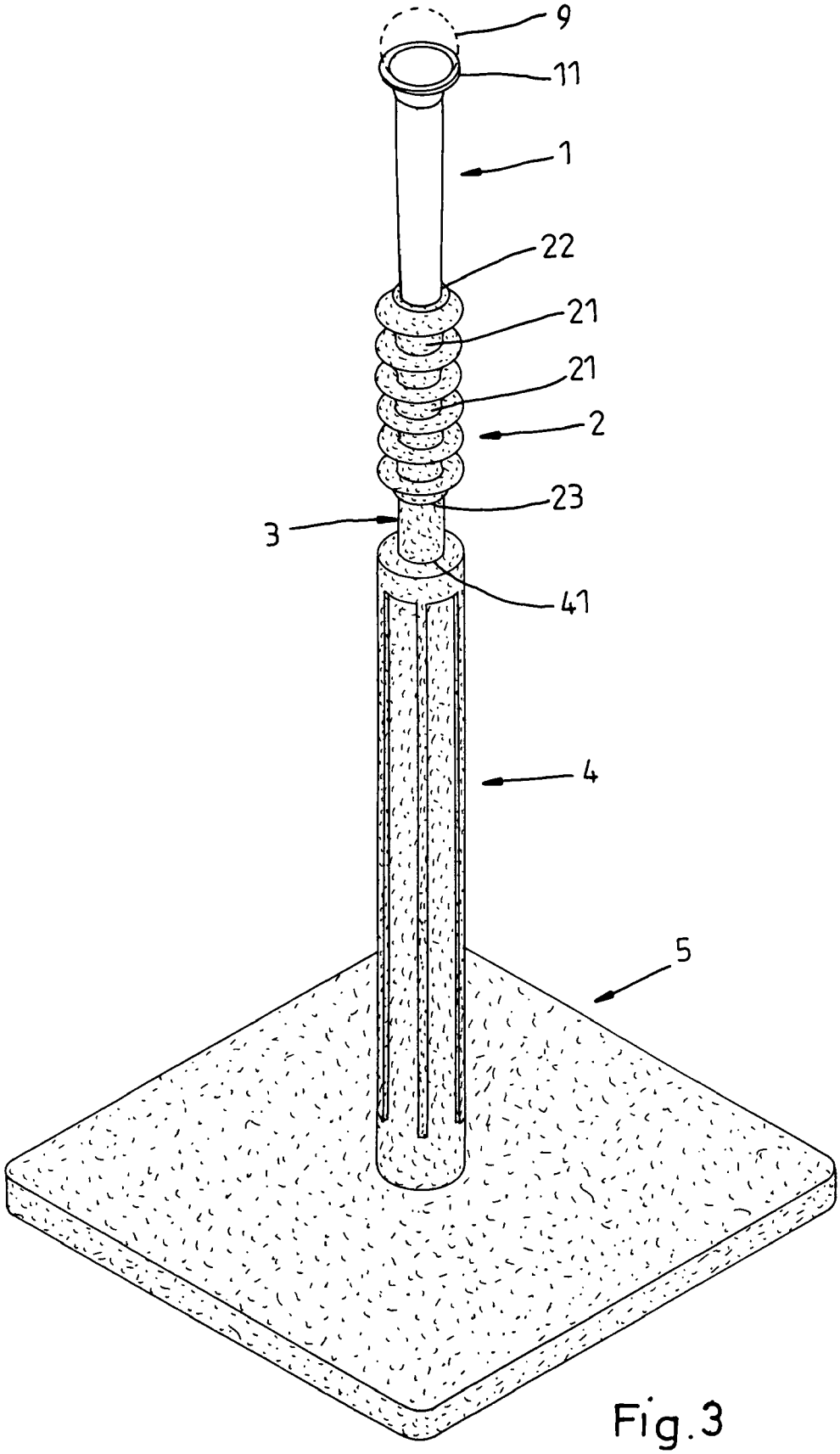
FIG. 3 is an elevational assembly view of the apparatus for practicing baseball batting according to the present invention.
Figure 4:
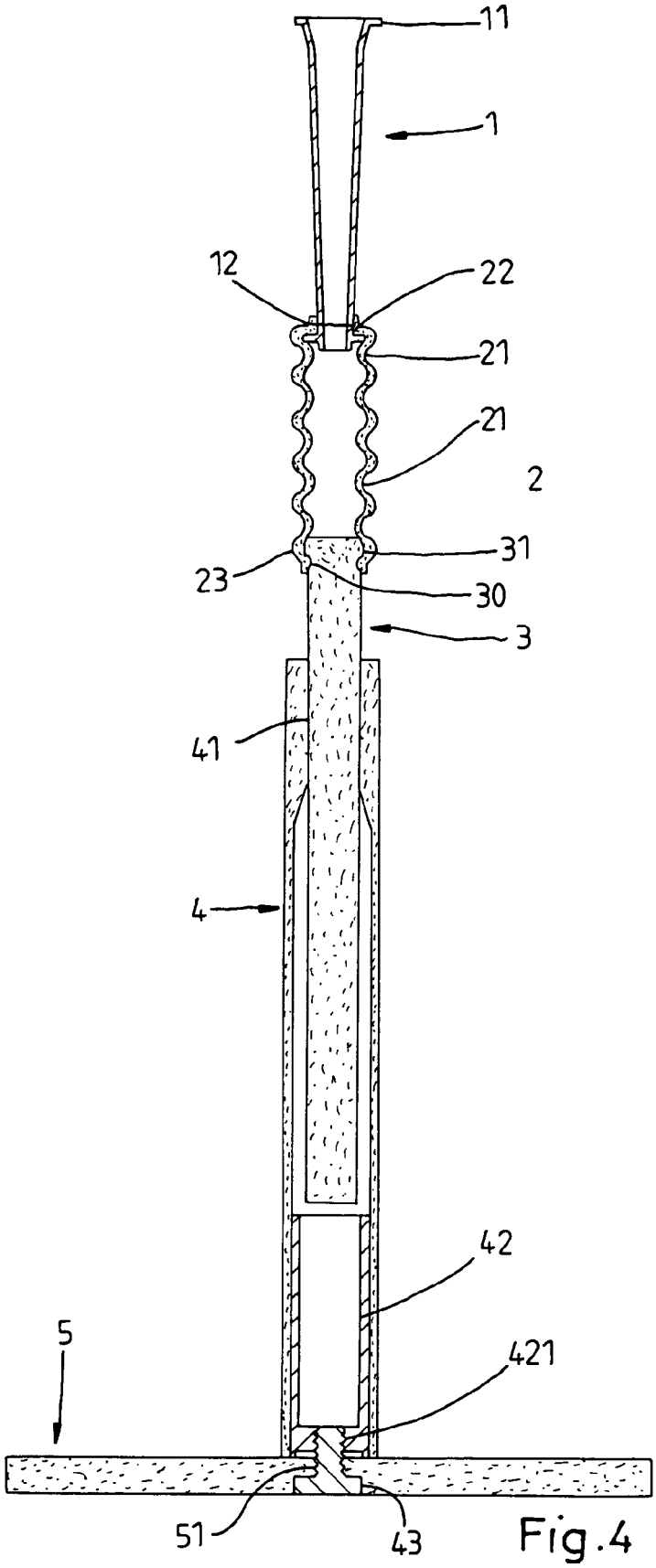
FIG. 4 is a longitudinal view in section of the apparatus for practicing baseball batting according to the present invention.

Referring to FIGS. 2~4, am apparatus for practicing baseball batting in accordance with the present invention is shown comprised of a ball holder 1, a flexible tube 2, a stem 3, an upright 4, and a base 5.

The ball holder 1 is a tubular member molded from plastics, having an expanded top ball seat 11 adapted to hold a ball 9 (see the dotted line in FIG. 3) for batting, and an engagement flange 12 extended around the periphery near the bottom end and press fitted into the top end of the flexible tube 2.

The flexible tube 2 is a hollow plastic tube having a plurality of annular grooves 21 extended around the periphery at different elevations, a top coupling hole 22 axially disposed in the top end and adapted to accommodate the engagement flange 12 of the ball holder 1, and a bottom coupling hole 23 axially disposed in the bottom end and adapted to accommodate the top end of the stem 3.

The stem 3 is molded from rubber, having an annular groove 30 extended around the periphery near the top end 31 for enabling the top end 31 to be engaged into the bottom coupling hole 23 of the flexible tube 2, and a bottom end 32 press fitted into the top end of the upright 4.

The base 5 is a rubber block, having a center through hole 51 through the top and bottom surfaces.

The upright right 4 has a top coupling hole 41 axially disposed in the top end and adapted to receive the bottom end 32 of the stem 3, and a metal screw holder 42 fixedly disposed in the bottom end and fastened to the center through hole 51 of the base 5 with a screw 43.

When the user missed the ball 9 and hit the ball holder 1 during practice, the flexible tube 2 is oscillated with the ball holder 1 to lessen shocks, preventing transmission of a big amount of shock waves to the base 5, and therefore the apparatus is maintained stable on the ground. Because the parts of the apparatus are made of rubber, the manufacturing cost of the apparatus is low. Further, because the apparatus is stable in use, no additional weight is necessary to hold the base in position. Therefore, the apparatus is not heavy, and can be conveniently carried from place to place.

When not in use, the ball holder 1, the flexible tube 2, the stem 3, the upright 4, and the base 5 can be detached from one another to reduce the storage space for storage or carrying.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An apparatus for practicing baseball batting, comprising:

a base formed of a rubber block, said base having a center through hole through top and bottom surfaces thereof;

an upright vertically supported on the top surface of said base, said upright having a metal screw holder fixedly provided in a bottom end thereof and fastened to the center through hole of said base with a screw, and a top coupling hole axially disposed in a top end thereof;

a rubber stem upwardly extended from said upright, said rubber stem having an annular groove extended around the periphery thereof near a top end, and a bottom end press fitted into the top coupling hole of said upright;

a flexible hollow plastic tube, said flexible hollow plastic tube having a plurality of annular grooves extended around the periphery thereof at different elevations, a top coupling hole axially disposed in a top end thereof, and a bottom coupling hole axially disposed in a bottom end thereof and fastened to the top end of said rubber stem; and a tubular rubber ball holder, said tubular rubber ball holder having an expanded top ball seat adapted to hold a ball for batting, and an engagement flange extended around the periphery near a bottom end thereof and press-fitted into the top coupling hole of said flexible tube.

* * * * *